US009856737B2

(12) United States Patent
Propheter-Hinckley

(10) Patent No.: US 9,856,737 B2
(45) Date of Patent: Jan. 2, 2018

(54) BLADES AND BLADE DAMPERS FOR GAS TURBINE ENGINES

(71) Applicant: UNITED TECHNOLOGIES CORPORATION, Farmington, CT (US)

(72) Inventor: Tracy A. Propheter-Hinckley, Manchester, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 310 days.

(21) Appl. No.: 14/639,490

(22) Filed: Mar. 5, 2015

(65) Prior Publication Data

US 2015/0330227 A1 Nov. 19, 2015

Related U.S. Application Data

(60) Provisional application No. 61/971,143, filed on Mar. 27, 2014.

(51) Int. Cl.

| | |
|---|---|
| ***F01D 5/16*** | (2006.01) |
| ***F01D 5/22*** | (2006.01) |
| *F01D 11/00* | (2006.01) |

(52) U.S. Cl.
CPC ..... *F01D 5/16* (2013.01); *F01D 5/22* (2013.01); *F01D 11/006* (2013.01); *F05D 2250/75* (2013.01)

(58) Field of Classification Search
CPC ..... F01D 5/00; F01D 5/10; F01D 5/16; F01D 5/22; F01D 5/24; F01D 5/26; F01D 25/04; F01D 25/06; F01D 11/006; F05D 2250/75
USPC ..... 416/106
See application file for complete search history.

(56) References Cited

U.S. PATENT DOCUMENTS 6,171,058 B1 * 1/2001 Stec ..... F01D 5/22 416/193 A

* cited by examiner

*Primary Examiner* — Woody Lee, Jr.
*Assistant Examiner* — Brian Delrue
(74) *Attorney, Agent, or Firm* — Cantor Colburn LLP

(57) ABSTRACT

A blade damper for a gas turbine blade includes a blade damper body with a first damping surface and a second damping surface. The first damping surface is on a first side of the damper body and the second damping surface is on a second side of the damper body opposite the first damping surface for providing full functionality in both flipped and unflipped orientations.

18 Claims, 7 Drawing Sheets

Fig. 3A
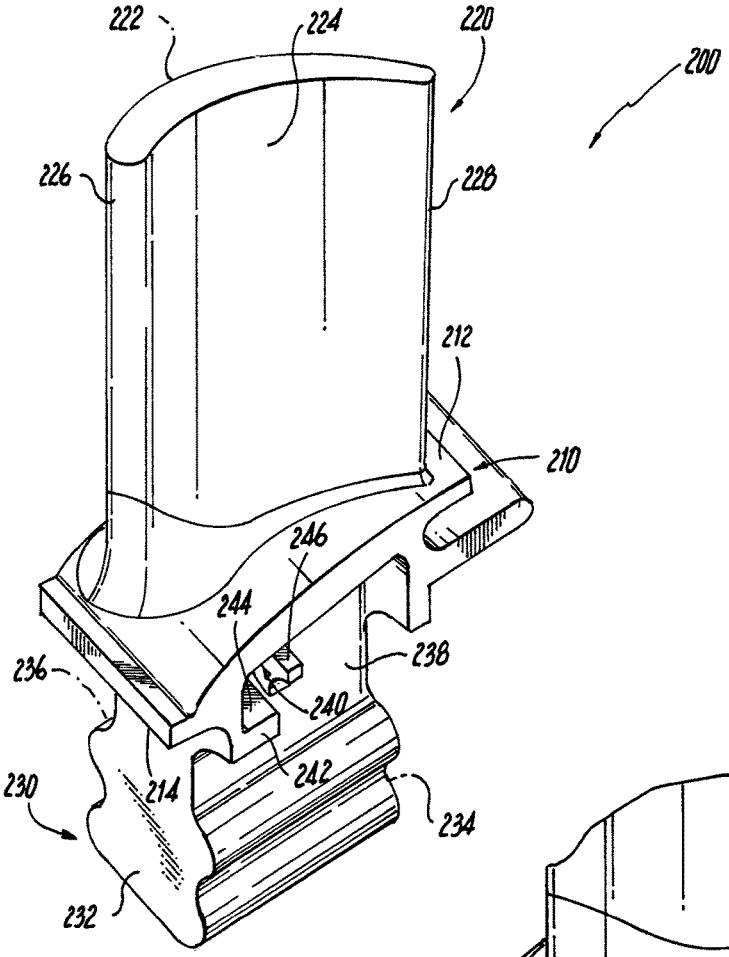
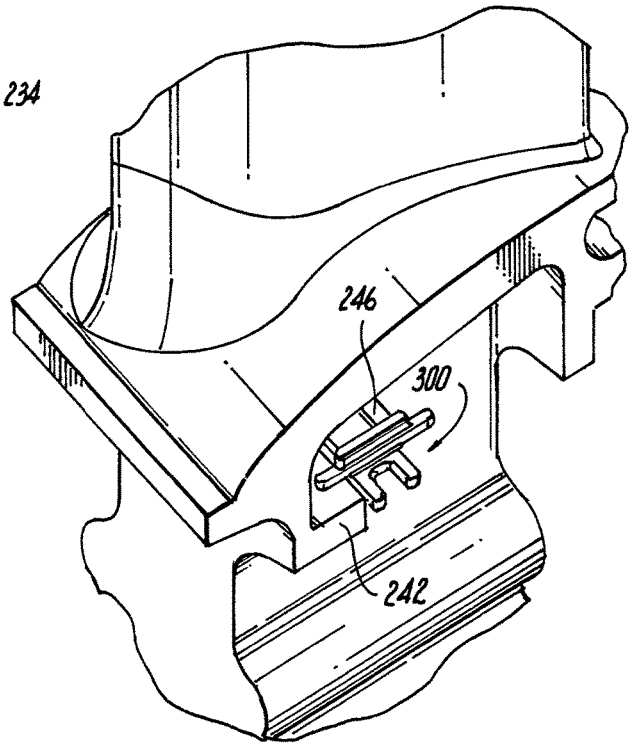
Fig. 3B

BLADES AND BLADE DAMPERS FOR GAS TURBINE ENGINES

CROSS-REFERENCE TO RELATED APPLICATION

This application claims the benefit of priority under 35 U.S.C. §119(e) to U.S. Provisional Application No. 61/971,143, filed Mar. 27, 2014, which is incorporated herein by reference in its entirety.

GOVERNMENT LICENSE RIGHTS STATEMENT

This invention was made with government support under Contract No. ND0019-12-D-0002-AY01 awarded by the United States Navy. The government has certain rights in the invention.

BACKGROUND OF THE INVENTION

1. Field of the Invention

The present disclosure relates to gas turbine engines, and more particularly to vibration dampers for gas turbine engine compressor and turbine disk blade assemblies.

2. Description of Related Art

Gas turbine engines typically include one or more compressor and turbine disk assemblies. The disk assemblies typically include a disk portion with disk slots defined about the circumference of the disk with blades seated in the slots. Some gas turbine engines include blade dampers positioned between the roots of adjacent blades between the undersides of adjacent blade platforms and the disk portion. Such blade dampers typically dampen the first vibratory mode of the airfoil during engine operation.

The dampening effect of conventional blade dampers is generally a function of the orientation of the blade damper in relation to the adjacent blades. Obtaining a desired or predetermined damping effect generally requires that the damper be installed in one or a limited number of orientations in order to provide a desired damping effect to the blades. In some engine designs the blade damper can be installed in an orientation where it does not provide the desired damping effect, potentially requiring removal and reinstallation of the blade damper such that it is installed in its intended orientation. Disk assemblies with relatively small blade dampers, such as high-pressure turbine disks, can be particularly susceptible to assembly errors due to blade damper orientation.

Such conventional turbine dampers have generally been considered satisfactory for their intended purpose. However, there is still a need in the art for improved turbine dampers that simplify engine assembly. The present disclosure provides solutions to this need.

SUMMARY OF THE INVENTION

A blade damper for a gas turbine blade includes a blade damper body with a first damping surface and a second damping surface. The first damping surface is on a first side of the damper body. The second damping surface is on a second side of the damper body opposite the first damping surface for providing full functionality in both a flipped and an unflipped orientation.

In certain embodiments, the first and second damping surfaces are angled with respect to one another. The first damping surface can be identical to the second damping surface when the damper body is flipped about its lateral axis and rotated about its radial axis. The first damping surface can be identical to the second damping surface when the damper body is flipped about its longitudinal axis and rotated about its radial axis. The damper body can have two-fold rotational symmetry about a symmetry axis of the damper body. It is contemplated that the symmetry axis can be a radial axis or a lateral axis of the damper body.

In accordance with certain embodiments, the damper body can define a first and a second leg parallel to the first leg. First and second bearing lobes can be defined by the first and second legs. The first and second bearing lobes can bound a first seal receptacle on a side of the damper body opposite the second damping surface. Third and fourth bearing lobes can be defined by the third and a fourth legs. The third and fourth bearing lobes can bound a second seal receptacle on a side opposite the first seal receptacle. It is contemplated that each of the first, second, third, and fourth legs can be coplanar with one another.

A blade configured for damping by the blade damper includes a blade platform, an airfoil, and a root. The airfoil extends radially outwards from the blade platform and has opposed pressure and suction sides. The root extends radially inwards from the blade platform and has pressure and suction sides. The root pressure and suction sides define first and second damper pockets configured to seat a blade damper in both flipped and unflipped damper orientations.

In certain embodiments, at least one of the damper pockets can be bounded by a slotted tang. The slotted tang can bound the damper pocket on a forward and/or an aft end of the damper pocket. The slotted tang can be a first slotted tang and a second slotted tang can bound the damper pocket on an end opposite the first slotted tang. It is further contemplated that at least one of the damper pockets can be bounded by a slotted protrusion. The slotted protrusion tang can be a first slotted protrusion and a second slotted protrusion can bound the pocket on an end opposite the first slotted protrusion.

A blade assembly for a gas turbine engine includes a blade disk, first and second turbine blades as described above, a blade damper as described above, and a feather seal. The blade disk defines first and second disk slots. Respective roots of the blades seat within the disk slots such that a gap is defined between the adjacent blade platforms. The blade damper underlies the gap such that the gap overlays the length of the first seal receptacle and the second seal receptacle extends between the facing damper pockets of the defined by the blade roots. A feather seal engages the first seal receptacle such that the feather seal underlays the gap.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 3A is a perspective side view of a turbine blade of the blade assembly of FIG. 2, showing a pocket for the blade damper;

FIG. 3B is a perspective side view of the blade damper and turbine blade of the assembly of FIG. 2, showing the blade damper seated in the pocket;

DETAILED DESCRIPTION OF THE PREFERRED EMBODIMENTS

Figure 1:
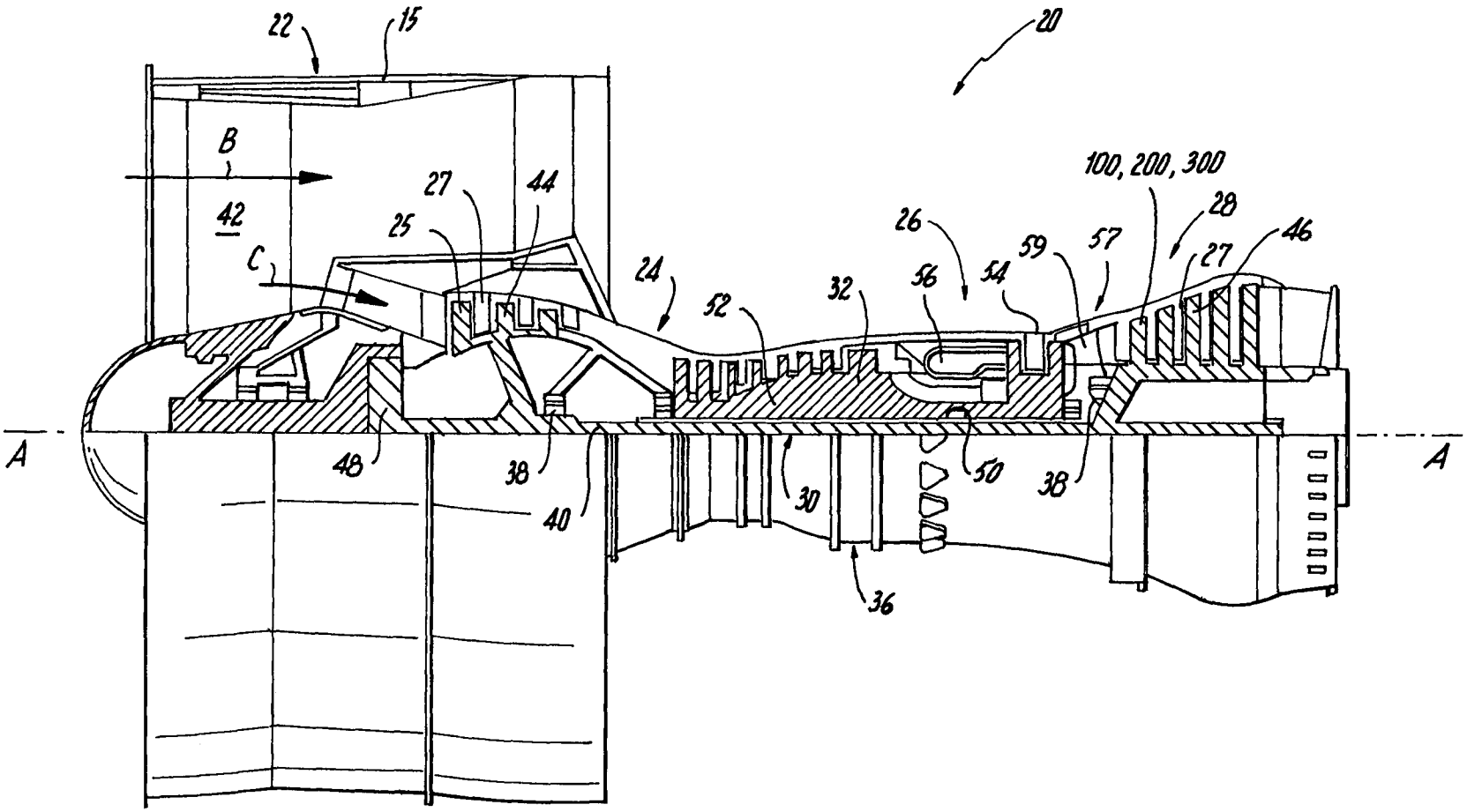
FIG. 1 is a cross-sectional schematic view of an exemplary embodiment of a gas turbine engine constructed in accordance with the present disclosure, showing a blade damper.

Reference will now be made to the drawings wherein like reference numerals identify similar structural features or aspects of the subject disclosure. For purposes of explanation and illustration, and not limitation, a partial view of an exemplary embodiment of the blade damper in accordance with the disclosure is shown in FIG. 1 and is designated generally by reference character 300. Other embodiments of blade dampers in accordance with the disclosure, or aspects thereof, are provided in FIGS. 2-7, as will be described. The systems and methods described herein can be used gas turbine engines such as in aircraft main engines.

With reference to FIG. 1, schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. Fan section 22 drives air along a bypass flow path B in a bypass duct defined within a nacelle 15, while the compressor section 24 drives air along a core flow path C for compression and communication into combustor section 26 followed by expansion through turbine section 28. Although depicted as a two-spool turbofan gas turbine engine in the disclosed non-limiting embodiment, it should be understood that the concepts described herein are not limited to use with two-spool turbofans as the teachings may be applied to other types of turbofan engines including three-spool engine architectures.

Exemplary gas turbine engine 20 generally includes a low speed spool 30 and high speed spool 32 mounted for rotation about an engine rotation axis A relative to an engine static structure 36 via several bearing systems 38. It should be understood that various bearing systems 38 at various locations may alternatively or additionally be provided, and the location bearing systems 38 may be varied as appropriate to the application.

Low speed spool 30 generally includes an inner shaft 40 that interconnects a fan 42, a first (or low) pressure compressor 44 and a first (or low) pressure turbine 46. Inner shaft 40 is connected to fan 42 through a speed change mechanism, which in exemplary gas turbine engine 20 is illustrated as a geared architecture 48 to drive fan 42 at a lower speed than low speed spool 30. High speed spool 32 includes an outer shaft 50 that interconnects a second (or high) pressure compressor 52 and a second (or high) pressure turbine 54. A combustor 56 is arranged in exemplary gas turbine engine 20 between high-pressure compressor 52 and high-pressure turbine 54. A mid-turbine frame 57 of engine static structure 36 is arranged generally between high-pressure turbine 54 and low-pressure turbine 46. Mid-turbine frame 57 further supports bearing systems 38 in turbine section 28. Inner shaft 40 and outer shaft 50 are concentric and rotate via bearing systems 38 about engine rotation axis A which is collinear with their rotation axes.

Core airflow is compressed by low-pressure compressor 44 then by high-pressure compressor 52, mixed and burned with fuel in combustor 56, then expanded over high-pressure turbine 54 and low-pressure turbine 46. Mid-turbine frame 57 includes airfoils 59, which are in core airflow path C. Low-pressure turbine 46 and high-pressure turbine 54 rotationally drive respective low speed spool 30 and high-speed spool 32 in response to the expansion. It will be appreciated that each of the positions of fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear section 48.

Each of compressor section 24 and turbine section 28 may include alternating rows of blade assemblies 100 including blades 200 and blade dampers 300 and vane assemblies (shown schematically). For example, the rotor assemblies can carry a plurality of rotating blades 200, while each vane assembly can carry a plurality of vanes 27 that extend into core flow path C. Blades 200 may either create or extract energy in the form of pressure from the core airflow as it is communicated along core flow path C. Vanes 27 direct core airflow to blades 25 to either add or extract energy.

Figure 2:
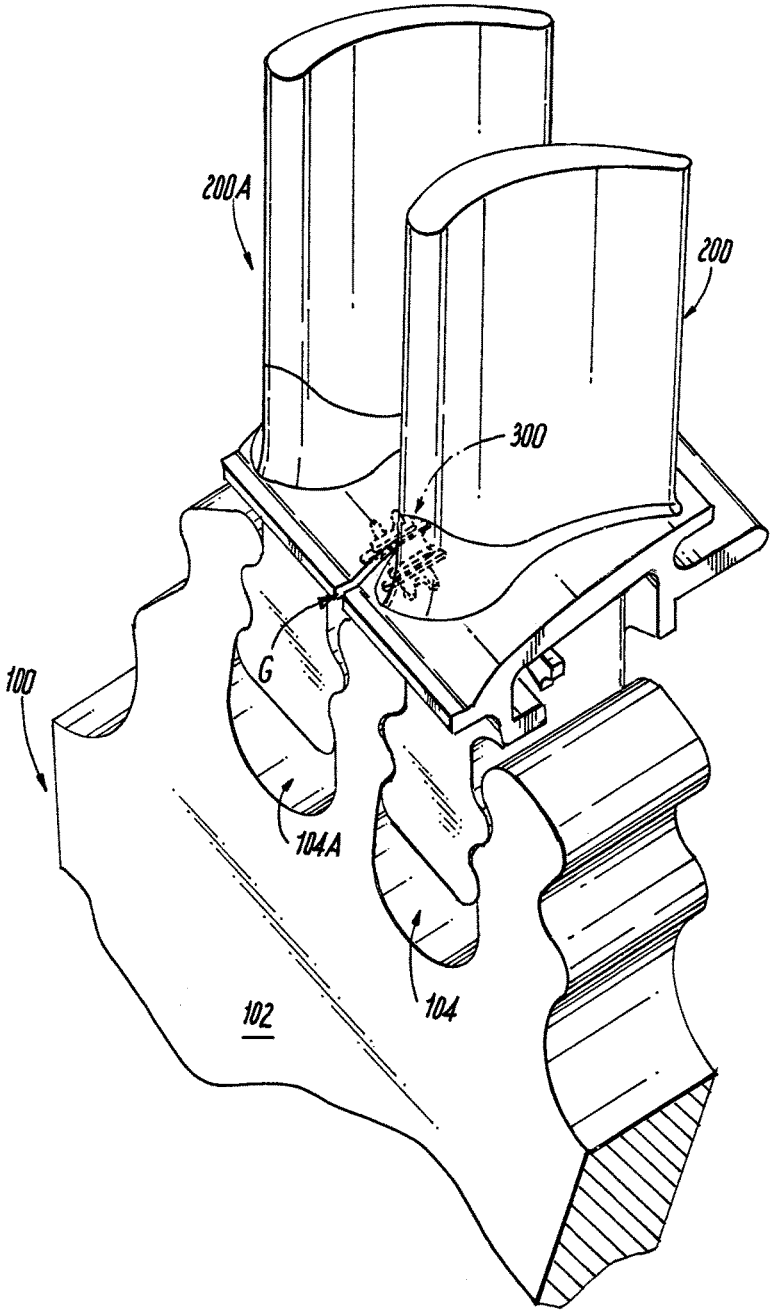
FIG. 2 is a schematic perspective view of a blade assembly, showing the blade damper arranged in the blade assembly.

With reference to FIG. 2, blade assembly 100 is shown. Blade assembly 100 is a turbine blade assembly and includes a blade disk 102, a first turbine blade 200, a second turbine blade 200A, and a blade damper 300. Blade disk 102 includes a disk body defining a first blade slot 104 and a second blade slot 104A disposed within a circumferential periphery of disk body 102. First and second turbine blades 200 and 200A are substantially identical to one another and are, for example, high-pressure turbine blades. As will be appreciated, blade assembly 100 can be a compressor or turbine blade assembly.

First turbine blade 200 has a root portion (described in further detail below) that seats within first blade slot 104. Second turbine blade 200A seats within second blade slot 104A such that one side (face) of the blade root faces a circumferentially adjacent side (face) of first turbine blade 200. Blade damper 300, illustrated schematically in dashed outline, seats between circumferentially adjacent sides (faces) of first and second turbine blades 200 and 200A. Blade damper 300 is movably captured between blade platforms (described in further detail below) and the circumferential periphery of blade disk 102. As will be appreciated by those skilled in the art, blade damper 300 is configured to provide a predetermined damping effect to first and second turbine blades 200 and 200A.

With reference to FIG. 3A and FIG. 3B, turbine blade 200 is shown. Turbine blade 200 includes a blade platform 210, an airfoil portion 220, and a root portion 230. Blade platform 210 includes a radially outward gas path surface 212 and an opposed radially inward inner surface 214. Airfoil portion 220 extends radially outward from gas path (working fluid path) surface 212 and defines a suction side 222, a pressure side 224, a forward edge 226, and an aft edge 228. With reference to working fluid flow in gas turbine engine 20 (shown in FIG. 1), forward edge 226 faces upstream and into the working fluid flow and aft edge 228 faces downstream.

Root portion 230 extends radially inward from inner surface 214 of blade platform 210. Root portion 230 has a forward face 232, an opposed aft face 234, a suction side 236, and an opposite pressure side 238. Root portion 230 defines a blade damper pocket 240 for seating blade damper 300 (shown in FIG. 4) against pressure side 238 of turbine blade 200. Pocket 240 is bounded on its forward end by a protrusion 242. Protrusion 242 forms a shelf 244 configured to accept an end of a leg of damper 300 (shown in FIG. 4). Pocket 240 is bounded on its aft end by a slotted tang 246 configured to receive an opposite end of the leg of damper 300 (shown in FIG. 4). Root portion 230 forms a corresponding pocket 250 (shown in FIG. 5B) on the suction side 236 of blade root 230. In FIG. 5A, blade damper 300 is shown seated in damper pocket 240 on protrusion 242 and slotted tang 246.

Figure 4:
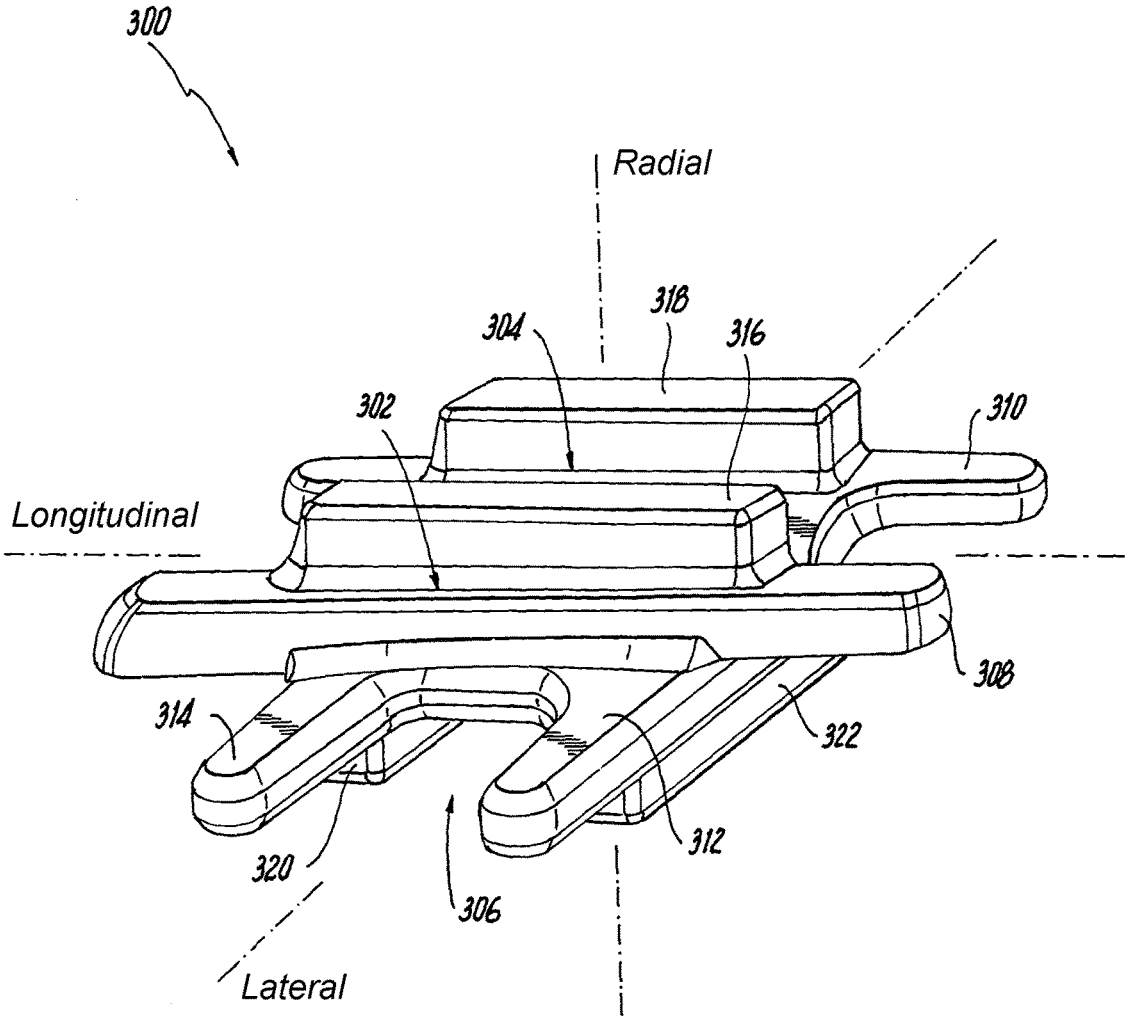
FIG. 4 is a perspective view of the blade damper of FIG. 2, showing the seal receptacles.
Figure 5A:
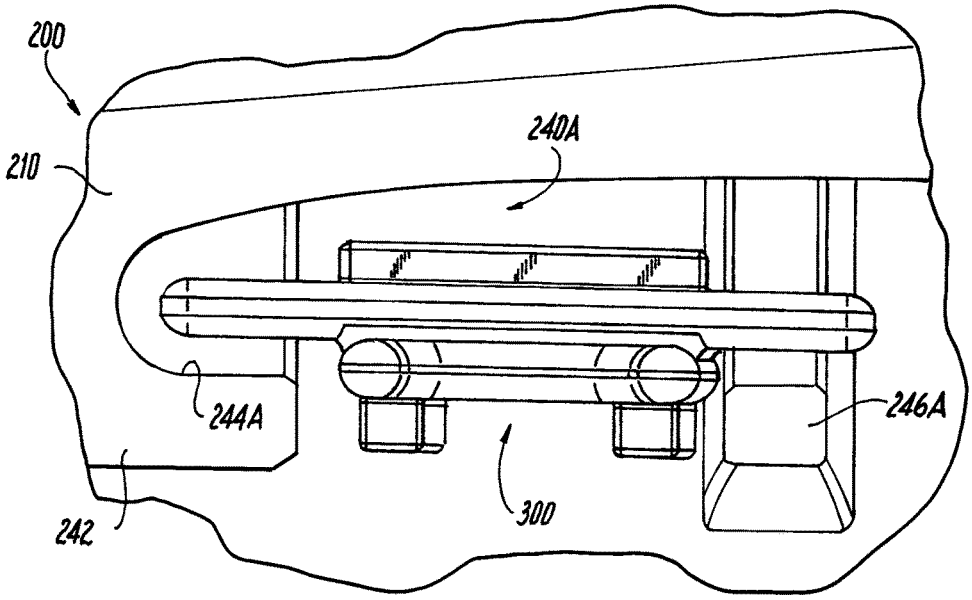
FIG. 5A is a side view of the turbine blade and blade damper of FIG. 2, showing the engagement of the blade root and blade damper.

With reference to FIG. 4, blade damper 300 is shown. Blade damper 300 includes a damper body 302. Damper body 302 includes a first bearing lobe 316, a second bearing lobe 318, a third bearing lobe 320, and a fourth bearing lobe 322. First and second bearing lobes 316 and 318 define a first damping surface. Third and fourth bearing lobes 320 and 322 define a second damping surface. As shown in FIG. 4, the first damping surface, i.e. radially outer surfaces of first and second bearing lobes 316 and 318, is on an opposite side of the second damping surface, i.e. radially inner surfaces of third and fourth bearing lobes 320 and 320.

Damper body 302 is configured to provide full functionality, e.g. a predetermined damping effect, in both flipped and unflipped orientations. In the illustrated embodiment, damper 300 is configured to provide a predetermined damping effect to first and second turbine blades 200 and 200A in at least three orientations. In a first orientation, blade damper 300 is installed into disk assembly 100 in an orientation where first bearing lobe 316 is adjacent to radially inner surface 214 of the blade platform of first blade 200 (shown in FIG. 3A). In a second orientation, blade damper 300 is installed into disk assembly 100 in an orientation where second bearing lobe 318 is adjacent to radially inner surface 214 of first blade 200 (shown in FIG. 3A). In a third orientation, blade damper 300 is installed into disk assembly 100 such that first bearing lobe 316 is adjacent to the radially outer surface of blade disk 102 (shown in FIG. 2). It will be understood that either third or fourth bearing lobe 320 and 322 is adjacent to radially inner surface 214 of first blade 200 (shown in FIG. 3A) in the third orientation. This simplifies assembly as there is no incorrect orientation within which the blade damper can be seated in the damper pocket, error-proofing the assembly process.

With continued reference to FIG. 4, first and second bearing lobes 316 and 318 define a first seal receptacle 304 and third and fourth bearing lobes 320 and 322 define a second seal receptacle 306 disposed on a side of damper body 302 opposite first seal receptacle 304. Second seal receptacle 306 is angled with respect to first seal receptacle 304. As illustrated, the angle is about 90 degrees. In embodiments, as will be appreciated by those skilled in the art, the angle can be any angle suitable given the geometry of the adjacent blade roots and blade platform.

Each of the first and second seal receptacles 304 and 306 are configured to receive a feather seal 350 (shown in FIG. 6) and for positioning feather seal 350 beneath a gap G (shown in FIG. 2) defined between adjacent blade platforms of first and second turbine blades 200 and 200A (shown in FIG. 2). As will be appreciated by those skilled in the art, this allows feather seal 350 to be in intimate mechanical contact with underside 214 of blade platform 210 such that feather seal 350 seals the region below blade platform 210 from working fluid traversing the gas path defined by surface 212.

Damper body 302 includes a first leg 308, a second leg 310, a third leg 312, and a fourth leg 314. First and second legs 308 and 310 laterally bound first seal receptacle 304. Third and fourth legs 312 and 314 laterally bound second seal receptacle 306. First and second legs 308 and 310 are parallel with a longitudinal axis of damper body 302. Third and fourth legs 312 and 314 are parallel with a lateral axis of damper body 302. As illustrated in FIG. 6B, the longitudinal and lateral axes of damper body 302 are angled to one another. The angle can be an oblique angle. Alternatively, the angle can be a 90-degree angle.

Damper body 302 also includes a first bearing lobe 316, a second bearing lobe 318, a third bearing lobe 320, and a fourth bearing lobe 322. First bearing lobe 316 is formed on a radially outer side of first leg 308 on a side of damper body 302 opposite second seal receptacle 306. Second bearing lobe 318 is formed on a radially outer side of second leg 310 on a side of damper body 302 opposite second seal receptacle 306. Third bearing lobe 320 is formed on a radially inner, forward side of third leg 314 on a side of damper body 302 opposite first seal receptacle 304. Fourth bearing lobe 322 is formed on a radially inner, aft side of fourth leg 312 on a side of damper body 302 opposite first seal receptacle 304. Each of the bearing surfaces have contours configured for providing a predetermined damping to effect turbine blades of blade assembly 100 when (a) underlying a single blade platform or, (b) underlying and spanning the gap between adjacent blade platforms (shown in FIG. 2).

Second seal receptacle 306 is identical with first seal receptacle 304 when damper body 302 is flipped about its longitudinal axis and rotated about its radial axis to align with the mate faces of adjacent platforms of first and second blades 200 and 200A (shown in FIG. 2). Second seal receptacle 306 is additionally identical to first seal receptacle 204 when damper body 302 is reversed (i.e. rotated) about its radial axis. In certain embodiments, second seal receptacle 306 can also identical with first seal receptacle 304 when damper body 302 is flipped about its lateral axis and rotated about its radial axis to align with the matefaces of adjacent platforms of first and second blades 200 and 200A (shown in FIG. 2).

Blade damper 300 has two-fold rotational symmetry about a symmetry axis of the damper body. As illustrated in FIG. 4, the symmetry axis is the radial axis—thereby allowing for reversing blade damper 300. It is also contemplated that, in certain embodiments, first and second legs 308 and 310 share common plane with third and fourth legs 310 and 312 such that second seal receptacle 306 is identical with first second seal receptacle 304 when rotated about the lateral axis of damper body 302. In such embodiments the lateral axis, the longitudinal axis, or both the lateral and longitudinal axes, can also form symmetry axes.

Figure 5B:
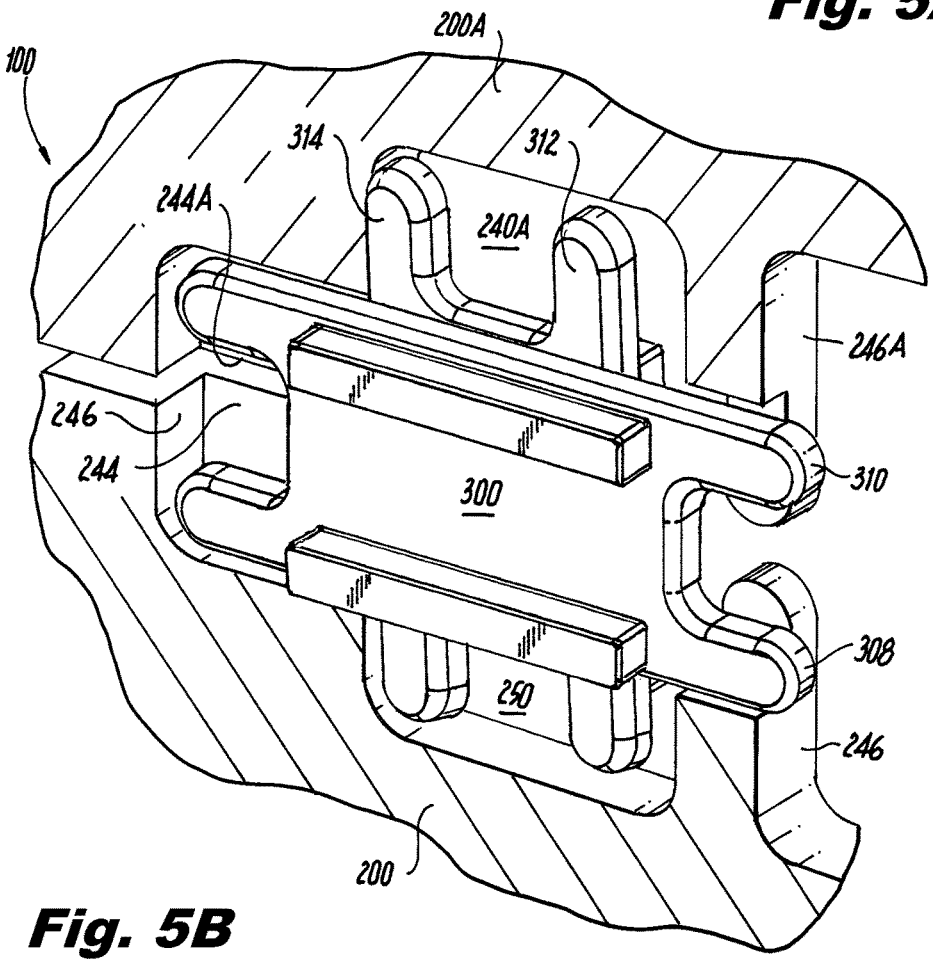
FIG. 5B is a top view of the blade damper installed within the blade assembly of FIG. 2, showing the blade damper movable captured in damper pockets of adjacent blades.

With reference to FIG. 5A and FIG. 5B, blade damper 300 is shown positioned in blade disk 100. First leg 310 seats across shelf 244A on its forward end and slotted tang 246A on its aft end. Second leg 308 seats across shelf 244 on its forward end and slotted tang 246 on its aft end. Third and fourth legs 312 and 314 respectively seat in damper pocket 240A on one lateral end and in damper pocket 250 on their opposite ends. When blades 200 and 200A are spun about the axis of rotation of gas turbine engine 20 by working fluid traversing airfoil portions 220 (shown in FIG. 3), bearing surfaces of damper body 302 are loaded onto the underside of the gas path side of blade platforms 210 of the adjacent blade while the sides of the lower bearing surfaces interact with the bearing shelf 244 and damper tang 246. This axially positions damper 300 between first and second blades 200 and 200A and disk body 102.

Figure 6A:
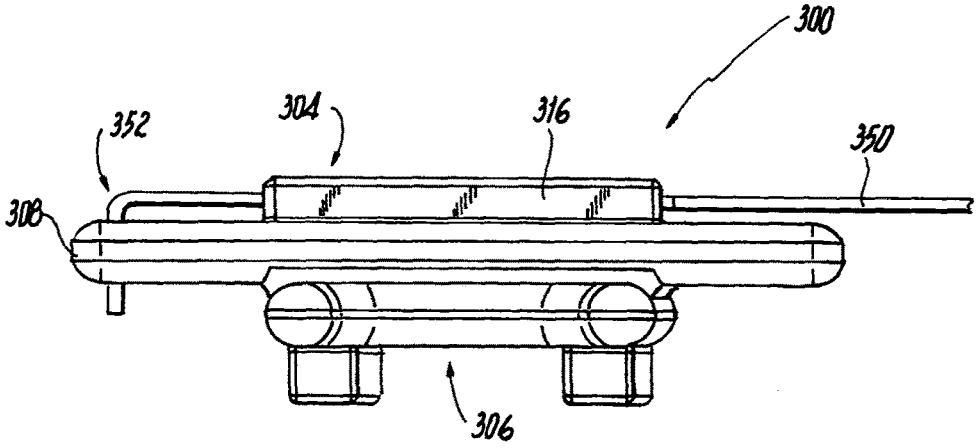
FIG. 6A is side view of a feather seal seated in the blade damper of FIG. 2, showing the feather seal seated in the first seal receptacle.
Figure 6B:
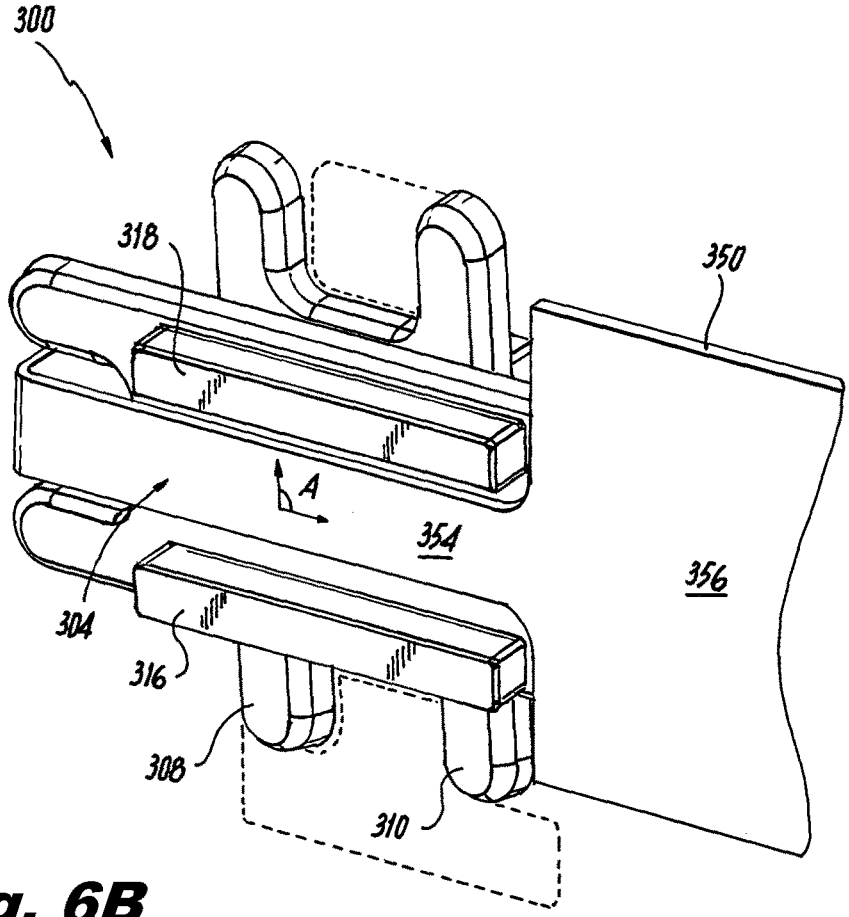
FIG. 6B is a plan view of the feather seal seated in the blade damper of FIG. 2, showing the feather seal seated in the second seal receptacle.

With reference to FIG. 6A and FIG. 6B, blade damper 300 is shown with optional feather seal 350. Feather seal 350 has a seal body formed from relatively thin sheet metal and defining a forward curved segment 352, a necked segment 354, and an aft segment 356. As illustrated, necked segment 354 seats in first seal receptacle 304 between first and second lobes 316 and 318 in a first position. It will be understood that necked segment 354 is positioned in substantially the same position when seated in second seal receptacle 306 (shown in dashed outline) when damper body 302 about its longitudinal axis and rotated about its radial axis.

Figure 7A:
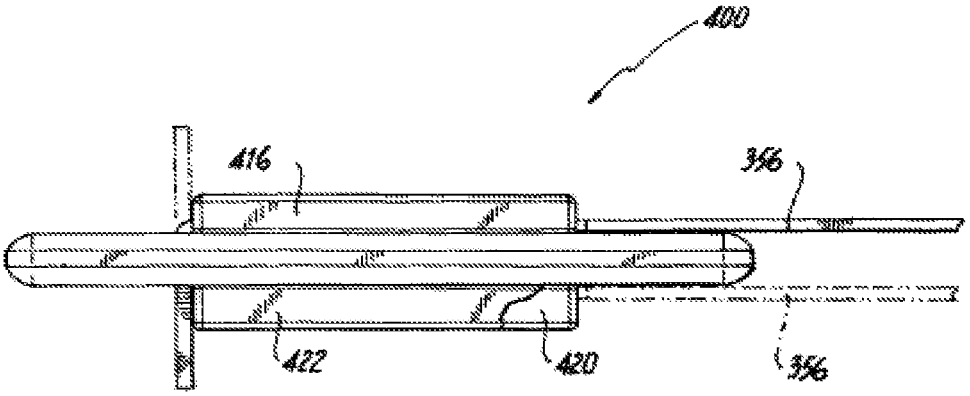
FIG. 7A and FIG. 7B are side the plan views of another embodiment of a blade damper.
Figure 7B:
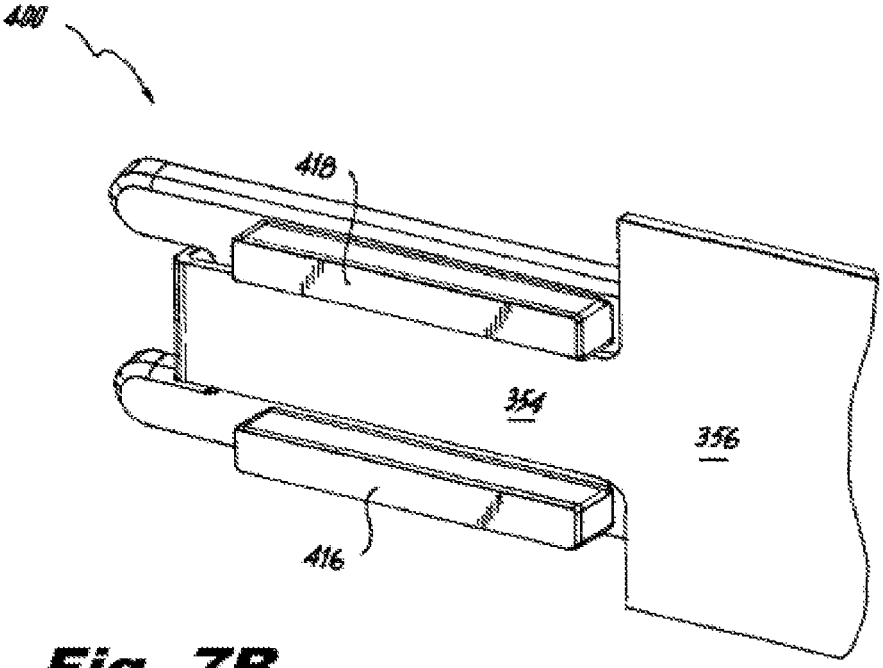

With reference to FIG. 7A and FIG. 7B, another embodiment of a blade damper 400 is shown. Blade damper 400 is similar to blade damper 300, and a first bearing surface (formed by first and second bearing lobes 416 and 418) that is aligned to a second bearing surface (formed by third and fourth bearing surfaces 420 and 422). This provided a blade damper with two-fold symmetry about both its radial axis and its longitudinal axes. It also provides a damper wherein the first and second bearing surfaces are identical when blade damper 400 is rotated about either its radial axis, and/or lateral, and/or its longitudinal axes. As illustrated in FIG. 7A, embodiments of blade damper 400 also seat feather seal 356 in opposed seal receptacles such that feather seal is in the same position in both an unflipped position (shown in solid outline) and flipped position (shown in dotted outline). This makes it more difficult to assemble blade damper 400 in an incorrect orientation.

The methods and systems of the present disclosure, as described above and shown in the drawings, provide blade dampers with superior properties including full functionality in multiple installation orientations. Full functionality in multiple damper orientations in turn provides ease of engine assembly during build and servicing as it reduces opportunity to miss-orient the blade damper in the blade assembly, thereby reducing assembly errors that could go undetected. Moreover, in blade disks having relatively small blade dampers, such assembly errors can be relatively easy to make without the benefit of this disclosure. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A blade for a gas turbine engine, comprising:

a blade platform;

an airfoil extending radially outwards from the blade platform with a pressure side and a suction side;

a root extending radially inwards from the blade platform with a pressure side and a suction side, wherein the root pressure side defines a damper pocket; and a blade damper seated within the damper pockets, wherein the blade damper includes a damper body having a first leg, a second leg disposed on a same side of the damper as the first leg, a third leg, and a fourth leg disposed on a same side of the damper as the third leg, the first leg and the second leg are parallel with a longitudinal axis of the damper body and the third leg and the fourth leg are parallel with a lateral axis that is disposed transverse to the longitudinal axis.

2. A blade as recited in claim 1, further including a slotted tang bounding an end of the damper pocket.

3. A blade as recited in claim 2, wherein the slotted tang is a first slotted tang and further including a second slotted tang bounding an aft end of the damper pocket.

4. A blade as recited in claim 2, further including a slotted protrusion bounding an end of the damper pocket.

5. A blade as recited in claim 4, wherein the slotted protrusion bounds a forward end of the damper pocket.

6. A blade as recited in claim 4, wherein the slotted protrusion is a first slotted protrusion, and further including a second slotted protrusion bounding an aft end of the damper pocket.

7. A blade assembly for a gas turbine engine, comprising:

a blade disk defining first and second disk slots;

first and second turbine blades, including:

adjacent blade platforms defining a gap therebetween;

respective airfoils extending radially outward from the blade platforms; and respective roots extending radially inward from the blade platforms and defining facing damper pockets, wherein the root of the first blade is seated in the first blade slot and the root of the second blade is seated in the second blade slot;

a blade damper with a damper body defining a first seal receptacle and a second seal receptacle on opposite sides of the damper body, the first seal receptacle laterally bounded by a first and second leg of the damper body and the second seal receptacle laterally bound by a third and fourth leg of the damper body; and a feather seal engaged in the first seal receptacle, wherein the blade damper underlays the gap between the blade platforms such that the gap overlays the length of the feather seal a the second seal receptacle extends between the facing damper pockets, wherein the blade damper provides full functionality in at least three orientations with respect to the gap.

8. A blade as recited in claim 1, wherein the damper body defines a first damping surface and a second damping surface on an opposite side of the damper body from the first damping surface, wherein the second damping surface is identical to the second damping surface for providing full functionality in at least three orientations.

9. A blade as recited in claim 4, wherein the slotted protrusion forms a shelf configured to accept an end of at least one of the first leg and the second leg.

10. A blade as recited in claim 9, wherein the slotted tang is configured to receive an opposite end of at least one of the first leg and the second leg.

11. A blade as recited in claim 8, wherein the damper body has a first and a second bearing lobe which define the first damping surface.

12. A blade as recited in claim 11, wherein the damper body has a third and a fourth bearing lobe which define the second damping surface.

13. A blade as recited in claim 12, wherein the first and second bearing lobes define a first seal receptacle extending between adjacent sides of the first and second bearing lobes and the third and fourth bearing lobes define a second seal receptacle extending between adjacent sides of the third and fourth bearing lobes.

14. A blade as recited in claim 13, wherein the first seal receptacle is laterally bound by the first and second legs, the second seal receptacle is laterally bound by the second seal receptacle, and wherein the second seal receptacle is angled with respect to the first seal receptacle.

15. A blade as recited in claim 8, wherein the second damping surface is identical to the first damping surface.

16. A blade as recited in claim 15, wherein the second damping surface is angled with respect to the first damping surface.

17. A blade as recited in claim 8, wherein the damper body has two-fold rotational symmetry about a symmetry axis of the damper body.

18. A blade as recited in claim 17, wherein the symmetry axis is a radial axis of the damper body.

* * * * *